US006523623B1

(12) United States Patent
Schuh

(10) Patent No.: US 6,523,623 B1
(45) Date of Patent: Feb. 25, 2003

(54) METHOD AND APPARATUS FOR DETERMINING DRILLING PATHS TO DIRECTIONAL TARGETS

(75) Inventor: Frank J. Schuh, Plano, TX (US)

(73) Assignee: Validus International Company, LLC, Dallas, TX (US)

( * ) Notice: Subject to any disclaimer, the term of this patent is extended or adjusted under 35 U.S.C. 154(b) by 0 days.

(21) Appl. No.: 09/866,814

(22) Filed: May 30, 2001

(51) Int. Cl.[7] ..... E21B 7/04
(52) U.S. Cl. ..... 175/45; 175/61; 175/62
(58) Field of Search ..... 175/45, 57, 61, 175/62, 220, 424

(56) References Cited

U.S. PATENT DOCUMENTS 4,420,049 A * 12/1983 Holbert
4,715,452 A * 12/1987 Sheppard
4,739,841 A * 4/1988 Das
4,854,397 A 8/1989 Warren et al.
5,193,628 A * 3/1993 Hill et al.
5,220,963 A * 6/1993 Patton
5,341,866 A 8/1994 Patton
5,419,405 A 5/1995 Patton
5,602,541 A 2/1997 Comeau et al.
5,812,068 A 9/1998 Wisler et al.
5,896,939 A 4/1999 Witte
5,931,239 A 8/1999 Schuh
6,109,370 A 8/2000 Gray

FOREIGN PATENT DOCUMENTS

WO WO 93/12319 6/1993

* cited by examiner

*Primary Examiner*—Roger Schoeppel
(74) *Attorney, Agent, or Firm*—Sughrue Mion, PLLC

(57) ABSTRACT

A method and apparatus for recomputing an optimum path between a present location of a drill bit and a direction or horizontal target uses linear approximations of circular arc paths. The technique does not attempt to return to a pre-planned drilling profile when there actual drilling results deviate from the preplanned profile. By recomputing an optimum path, the borehole to the target has a reduced tortuosity.

36 Claims, 10 Drawing Sheets

PLANNED TRAJECTORY FOR A HORIZONTAL TARGET

COMPARISON OF
CONVENTIONAL OILFIELD PATH ADJUSTMENTS
TO A RE-DESIGNED OPTIMUM PATH

A SINGLE CIRCULAR ARC
WITH A TANGENT SECTION
TO A DIRECTIONAL TARGET

TWO CIRCULAR ARCS
WITH A TANGENT SECTION
TO A DIRECTIONAL TARGET

SINGLE CIRCULAR ARC PATH
THAT LANDS ON A SLOPING PLANE

A TWO-CIRCULAR ARC PATH
THAT LANDS ON A SLOPING PLANE

BT= Curvature rate deg/100 ft $$R = \frac{100 \cdot 180}{BT \cdot \pi}$$

$$LR = \frac{100 \cdot DOG}{BT}$$

$$LA = R \cdot \tan\left\{\frac{DOG}{2}\right\}$$

CIRCULAR ARC RELATIONSHIPS

PLANNED TRAJECTORY FOR
THREE DIRECTIONAL TARGETS

PLANNED TRAJECTORY FOR
A HORIZONTAL TARGET

BOTTOM HOLE ASSEMBLY

METHOD AND APPARATUS FOR DETERMINING DRILLING PATHS TO DIRECTIONAL TARGETS

FIELD OF THE INVENTION

This invention provides an improved method and apparatus for determining the trajectory of boreholes to directional and horizontal targets. In particular, the improved technique replaces the use of a preplanned drilling profile with a new optimum profile that maybe adjusted after each survey such that the borehole from the surface to the targets has reduced tortuosity compared with the borehole that is forced to follow the preplanned profile. The present invention also provides an efficient method of operating a rotary steerable directional tool using improved error control and minimizing increases in torque that must be applied at the surface for the drilling assembly to reach the target.

BACKGROUND

Controlling the path of a directionally drilled borehole with a tool that permits continuous rotation of the drillstring is well established. In directional drilling, planned borehole characteristics may comprise a straight vertical section, a curved section, and a straight non-vertical section to reach a target. The vertical drilling section does not raise significant problems of directional control that require adjustments to a path of the downhole assembly. However, once the drilling assembly deviates from the vertical segment, directional control becomes extremely important.

FIG. 1 illustrates a preplanned trajectory between a kick-off point KP to a target T using a broken line A. The kickoff point KP may correspond to the end of a straight vertical segment or a point of entry from the surface for drilling the hole. In the former case, this kick-off point corresponds to coordinates where the drill bit is assumed to be during drilling. The assumed kick-off point and actual drill bit location may differ during drilling. Similarly, during drilling, the actual borehole path B will often deviate from the planned trajectory A. Obviously, if the path B is not adequately corrected, the borehole will miss its intended target. At point D, a comparison is made between the preplanned condition of corresponding to planned point on curve A and the actual position. Conventionally, when such a deviation is observed between the actual and planned path, the directional driller redirects the assembly back to the original planned path A for the well. Thus, the conventional directional drilling adjustment requires two deflections. One deflection directs the path towards the original planned path A. However, if this deflection is not corrected again, the path will continue in a direction away from the target. Therefore, a second deflection realigns the path with the original planned path A.

There are several known tools designed to improve directional drilling. For example, BAKER INTEQ'S "Auto Trak" rotary steerable system uses a closed loop control to keep the angle and azimuth of a drill bit oriented as closely as possible to preplanned values. The closed loop control system is intended to porpoise the hole path in small increments above and below the intended path. Similarly, Camco has developed a rotary steerable system that controls a trajectory by providing a lateral force on the rotatable assembly. However, these tools typically are not used until the wellbore has reached a long straight run, because the tools do not adequately control curvature rates.

An example of controlled directional drilling is described by Patton (U.S. Pat. No. 5,419,405). Patton suggests that the original planned trajectory be loaded into a computer which is part of the downhole assembly. This loading of the trajectory is provided while the tool is at the surface, and the computer is subsequently lowered into the borehole. Patton attempted to reduce the amount of tortuosity in a path by maintaining the drilling assembly on the preplanned profile as much as possible. However, the incremental adjustments to maintain alignment with the preplanned path also introduce a number of kinks into the borehole.

As the number of deflections in a borehole increases, the amount of torque that must be applied at the surface to continue drilling also increases. If too many corrective turns must be made, it is possible that the torque requirements will exceed the specifications of the drilling equipment at the surface. The number of turns also decreases the amount of control of the directional drilling.

In addition to Patton '405, other references have recognized the potential advantage of controlling the trajectory of the tool downhole. (See for example, Patton U.S. Pat. No. 5,341,886, Gray, U.S. Pat. No. 6,109,370, WO93112319, and Wisler, U.S. Pat. No. 5,812,068). It has been well recognized that in order to compute the position of the borehole downhole, one must provide a means for defining the depth of the survey in the downhole computer. A variety of methods have been identified for defining the survey depths downhole. These include:

1. Using counter wheels on the bottom hole assembly, (Patton, U.S. Pat. No. 5,341,886)
2. Placing magnetic markers on the formation and reading them with the bottom hole assembly, (Patton, U.S. Pat. No. 5,341,886)
3. Recording the lengths of drillpipe that will be added to the drillstring in the computer while it is at the surface and then calculating the survey depths from the drillpipe lengths downhole. (Witte, U.S. Pat. No. 5,896,939).

While these downhole systems have reduced the time and communications resources between a surface drilling station and the downhole drilling assembly, no technique is known that adequately addresses minimizing the tortuosity of a drilled hole to a directional or horizontal target.

SUMMARY OF THE INVENTION

Applicant's invention overcomes the above deficiencies by developing a novel method of computing the optimum path from a calculated position of the borehole to a directional or horizontal target. Referring to FIG. 1, at point D, a downhole calculation can be made to recompute a new trajectory C, indicated by the dotted line from the deviated position D to the target T. The new trajectory is independent of the original trajectory in that it does not attempt to retrace the original trajectory path. As is apparent from FIG. 1, the new path C has a reduced number of turns to arrive at the target. Using the adjusted optimum path will provide a shorter less tortuous path for the borehole than can be achieved by readjusting the trajectory back to the original planned path A. Though a downhole calculation for the optimum path C is preferred, to obviate delays and to conserve communications resources, the computation can be done downhole or with normal directional control operations conducted at the surface and transmitted. The transmission can be via a retrievable wire line or through communications with a non-retrievable measure-while-drilling (MWD) apparatus.

By recomputing the optimum path based on the actual position of the borehole after each survey, the invention optimizes the shape of the borehole. Drilling to the target may then proceed in accordance with the optimum path determination.

The invention recognizes that the optimum trajectory for directional and horizontal targets consists of a series of circular arc deflections and straight line segments. A directional target that is defined only by the vertical depth and its north and east coordinates can be reached from any point above it with a circular arc segment followed by a straight line segment. The invention further approximates the circular arc segments by linear elements to reduce the complexity of the optimum path calculation.

PREFERRED EMBODIMENTS OF INVENTION

Preferred embodiments of the invention are set forth below with reference to the drawings where:

Figure 10:
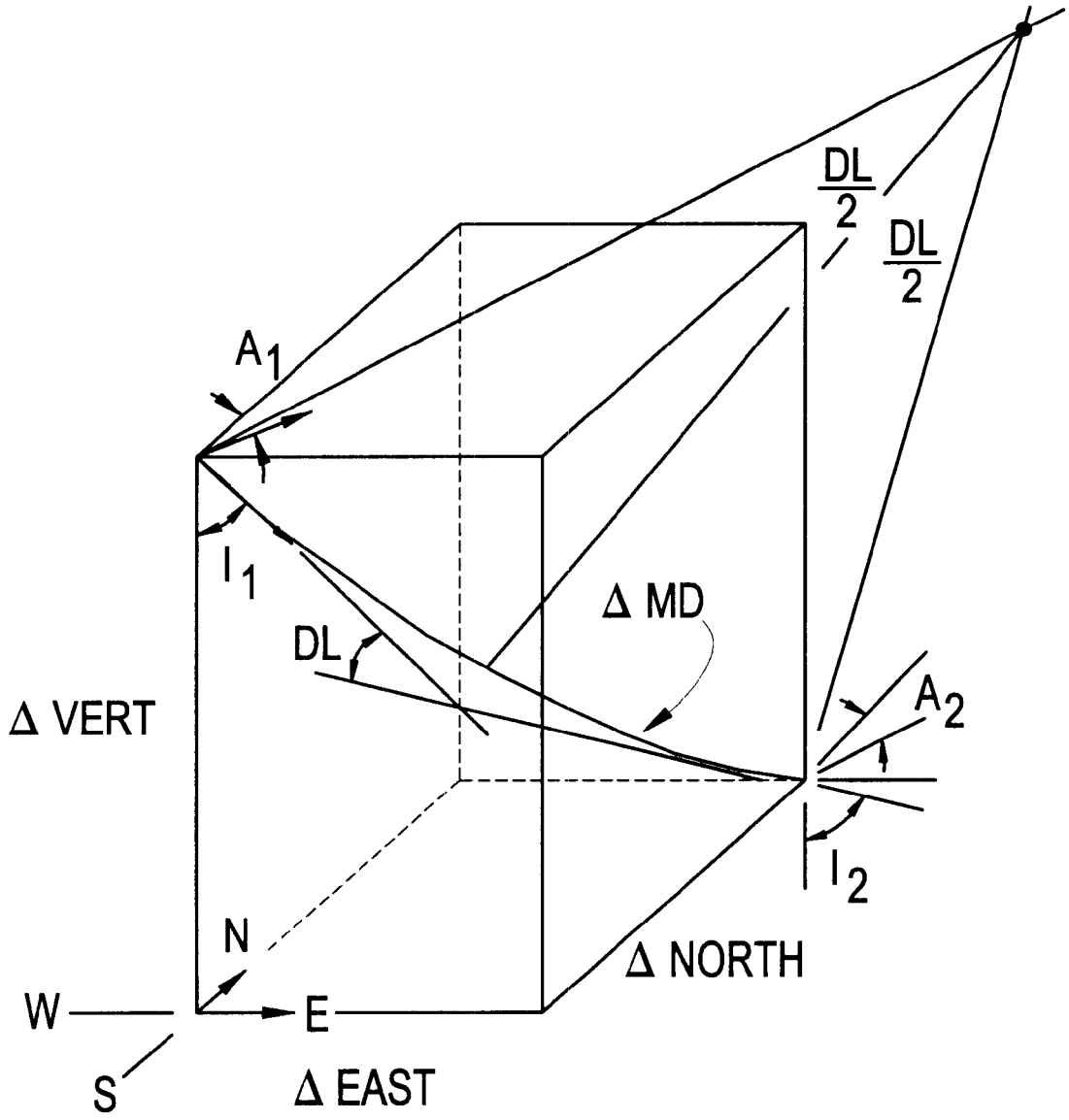
FIG. 10 illustrates a known geometric relationship for determining minimum curvature paths.

The method of computing the coordinates along a circular arc path is well known and has been published by the American Petroleum Institute in "Bulletin D20". FIG. 10 illustrates this known geometric relationship commonly used by directional drillers to determine a minimum curvature solution for a borehole path.

In the known relationship, the following description applies:

DL is the dogleg angle, calculated in all cases by the equation:

$$\cos(DL)=\cos(I_2-I_1)-\sin(I_1)\cdot\sin(I_2)\cdot(1-\cos(A_2-A_1))$$

or in another form as follows:

$$\cos(DL)=\cos(A_2-A_1)\cdot\sin(I_1)\cdot\sin(I_2)+\cos(I_1)\cdot\cos(I_2)$$

Since the measured distance (ΔMD) is measured along a curve and the inclination and direction angles (I and A) define straight line directions in space, the conventional methodology teaches the smoothing of the straight line segments onto the curve. This is done by using the ratio factor RF. Where RF=(2/DL)·Tan (DL/2); for small angles (DL<0.25°), it is usual to set RF=1.

$$\text{Then: } \Delta\text{North} = \frac{\Delta MD}{2}[\sin(I_1)\cdot\cos(A_1)+\sin(I_2)\cdot\cos(A_2)]\cdot RF$$

$$\Delta\text{East} = \frac{\Delta MD}{2}[\sin(I_1)\cdot\sin(A_1)+\sin(I_2)\cdot\sin(A_2)]\cdot RF$$

$$\Delta\text{Vert} = \frac{\Delta MD}{2}[\cos(I_1)+\cos(I_2)]\cdot RF$$

Once the curvature path is determined, it is possible to determine what coordinates in space fall on that path. Such coordinates provide reference points which can be compared with measured coordinates of an actual borehole to determine deviation from a path.

The methods and tools to obtain actual measurements of the bottom hole assembly, such as measured depth, azimuth and inclination are generally well-known. For instance, Wisler U.S. Pat. No. 5,812,068, Warren U.S. Pat. No. 4,854,397, Comeau U.S. Pat. No. 5,602,541, and Witte U.S. Pat. No. 5,896,939 describe known MWD tools. To the extent that the measurements do not impact the invention, no further description will be provided on how these measurements are obtained.

Though FIG. 10 allows one skilled in the art to determine the coordinates of an arc, the form of the available survey equations is unsuitable for reversing the process to calculate the circular arc specifications from actual measured coordinates. The present invention includes a novel method for determining the specifications of the circular arc and straight line segments that are needed to calculate the optimum trajectory from a point in space to a directional or horizontal target. The improved procedure is based on the observation that the orientations and positions of the end points of a circular arc are identical to the ends of two connected straight line segments. The present invention uses this observation in order to determine an optimum circular arc path based on measured coordinates.

Figure 6:
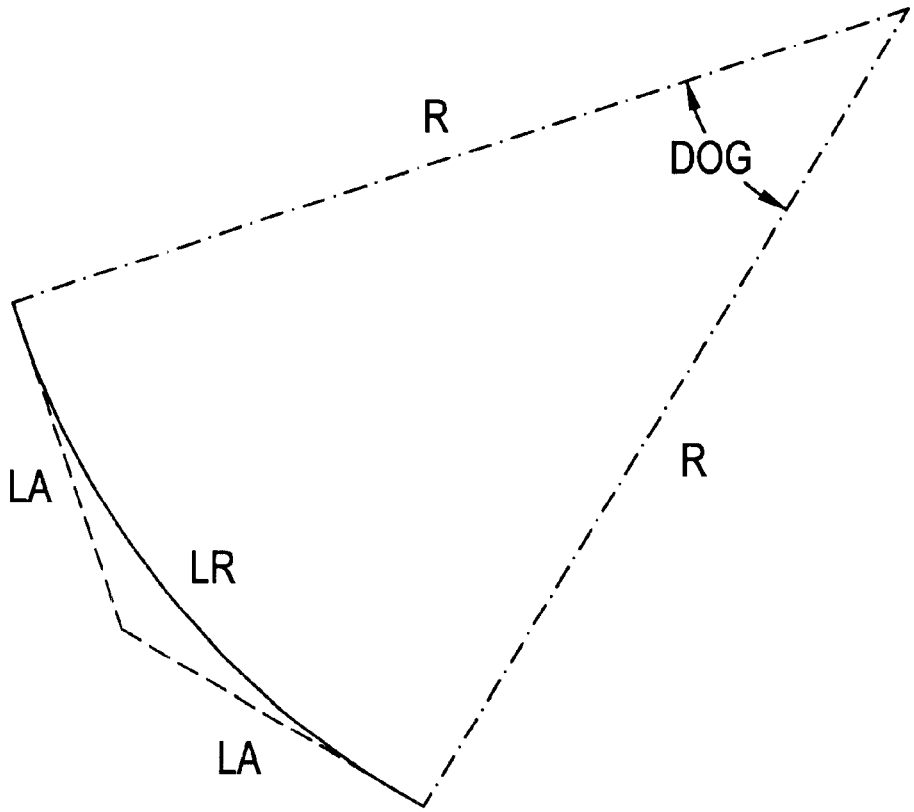
FIG. 6 illustrates the relationship between the length of line segments approximating an arc and a dogleg angle defining the curvature of the arc to determine an optimized path according to a preferred embodiment of the invention.

As shown in FIG. 6, the two segments LA are of equal length and each exactly parallels the angle and azimuth of the ends of the circular arc LR. Furthermore, the length of the straight line segments can easily be computed from the specifications of the circular arc defined by a DOG angle and radius R to define the arc LR and vice versa. In particular, the present inventor determined the length LA to be R*tan (DOG/2). Applicant further observed that by replacing the circular arcs required to hit a directional or horizontal target with their equivalent straight line segments, the design of the directional path is reduced to a much simpler process of designing connected straight line segments. This computation of the directional path from a present location of the drill bit may be provided each time a joint is added to the drill-string. Optimum results, e.g. reduced tortuosity, can be achieved by recomputing the path to the target after each survey.

Tables 1–4, below, comprise equations that may be solved reiteratively to arrive at an appropriate dogleg angle DOG and length LA for a path between a current location of a drill bit and a target. In each of the tables, the variables are defined as follows:

Nomenclature

| | |
|---|---|
| AZDIP = Azimuth of the direction of dip for a sloping target plane | deg North |
| AZ = Azimuth angle from North | deg North |
| BT = Curvature rate of a circular arc | deg/100 ft |
| BTA = Curvature rate of the upper circular arc | deg/100 ft |
| BTB = Curvature rate of the lower circular arc | deg/100 ft |
| DAZ = Difference between two azimuths | deg |
| DAZ1 = Difference between azimuth at the beginning and end of the upper curve | deg |
| DAZ2 = Difference between azimuth at the beginning and end of the lower curve | deg |
| DEAS = Easterly distance between two points | ft |
| DIP = Vertical angle of a sloping target plane measured down from a horizontal plane | deg |
| DMD = Distance between two points | ft |
| DNOR = Northerly distance between two points | ft |
| DOG = Total change in direction between ends of a circular arc | deg |
| DOG1 = Difference between inclination angles of the circular arc | deg |
| DOG2 = Difference between inclination angles of the circular arc | deg |
| DOGA = Total change in direction of the upper circular arc | deg |
| DOGB = Total change in direction of the lower circular arc | deg |
| DTVD = Vertical distance between two points | ft |

-continued

| | |
|---|---|
| DVS = Distance between two points projected to a horizontal plane | ft |
| EAS = East coordinate | ft |
| ETP = East coordinate of vertical depth measurement position | ft |
| HAT = Vertical distance between a point and a sloping target plane, (+) if point is above the plane | ft |
| INC = Inclination angle from vertical | deg |
| LA = Length of tangent lines that represent the upper circular arc | ft |
| LB = Length of tangent lines that represent the lower circular arc | ft |
| MD = Measured depth along the wellbore from surface | ft |
| MDL = Measured depth along tangent lines | ft |
| NOR = North coordinate | ft |
| NTP = North coordinate of vertical depth measurement position | ft |
| TARGAZ = Target azimuth for horizontal target | deg North |
| TVD = Vertical depth from surface | ft |
| TVDT = Vertical depth of a sloping target plane at north and east coordinates | ft |
| TVDTP = Vertical depth to a sloping target plane at NTP and ETP coordinates | ft |

Figure 1:
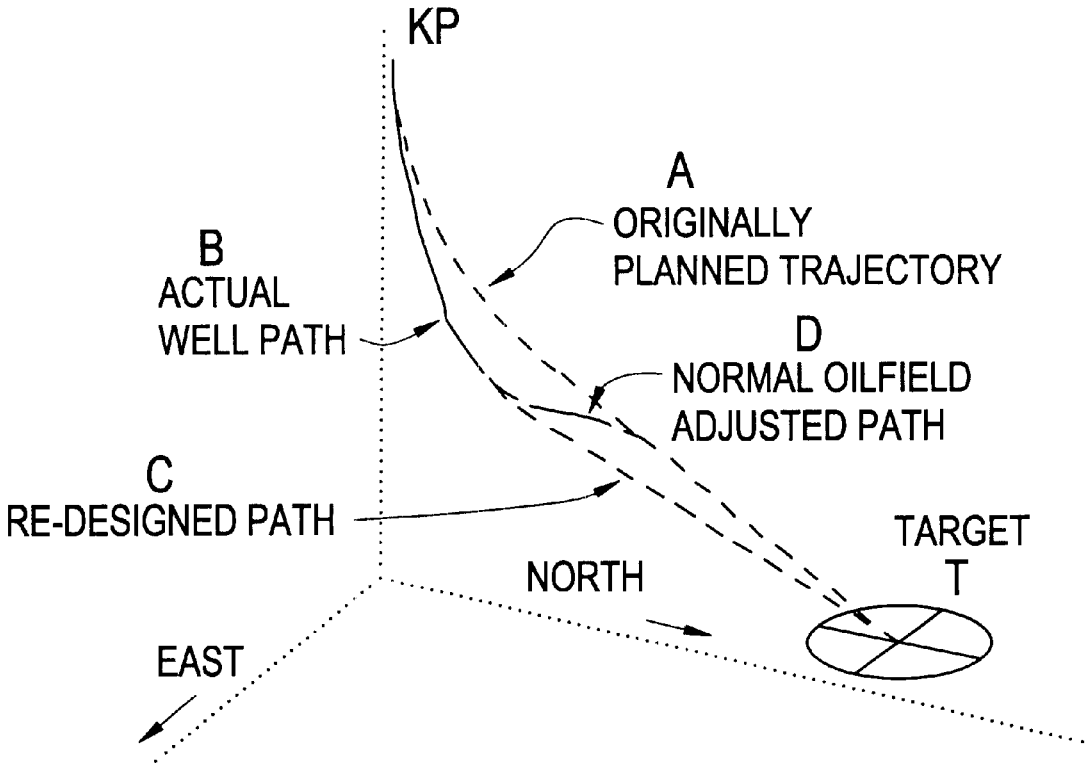
FIG. 1 illustrates a comparison between the path of a conventional corrective path and an optimized path determined according to a preferred embodiment of the present invention.
Figure 2:
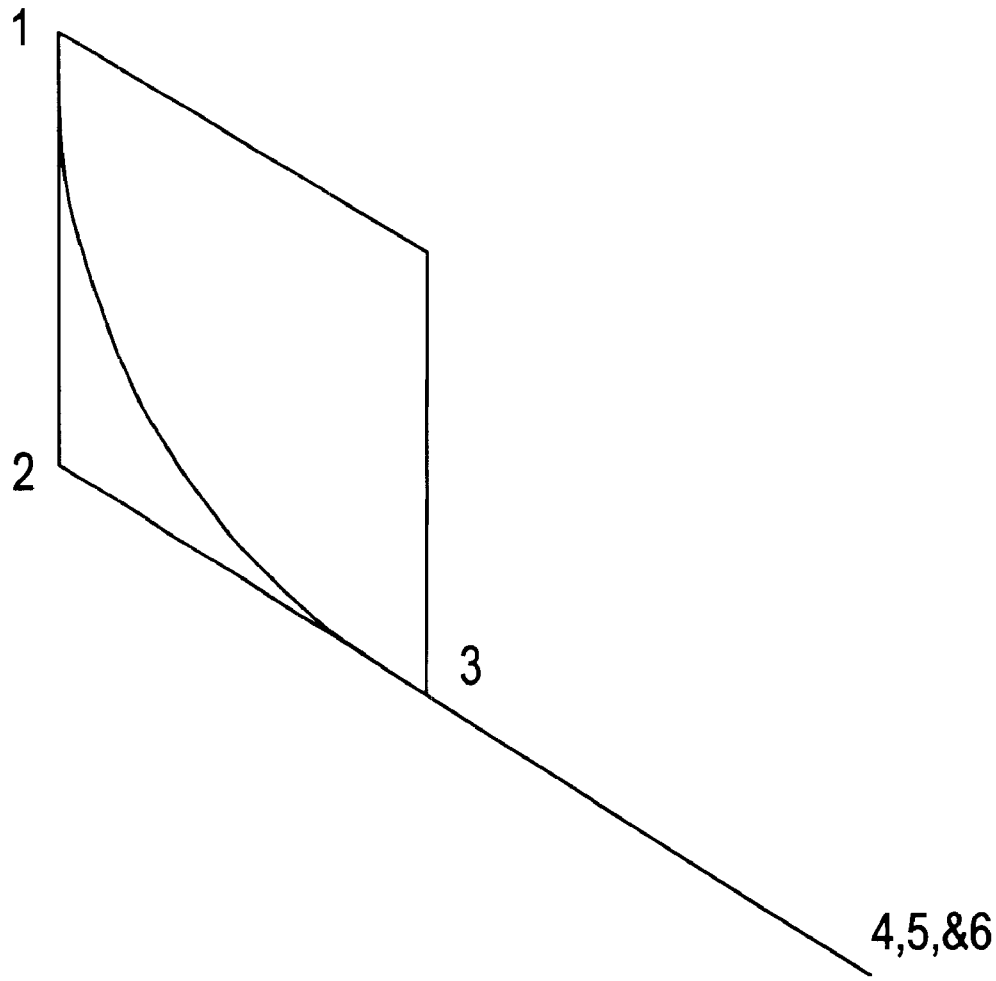
FIG. 2 illustrates a solution for an optimized path including an arc and a tangent line.

FIG. 2 and Table 1 show the process for designing a directional path comprising a circular arc followed by a straight tangent section that lands on a directional target.

TABLE 1

Single Curve and Tangent to a Directional Target
GIVEN: BTA
Starting position: MD(1), TVD(1), EAS(1), NOR(1), INC(1), AZ(1)
Target position: TVD(4), EAS(4), NOR(4)

$$LA = 0 \quad (1)$$
$$MDL(1) = MD(1) \quad (2)$$
$$MDL(2) = MDL(1) + LA \quad (3)$$
$$MDL(3) = MDL(2) + LA \quad (4)$$
$$DVS = LA \cdot \sin[INC(1)] \quad (5)$$
$$DNOR = DVS \cdot \cos[AZ(1)] \quad (6)$$
$$DEAS = DVS \cdot \sin[AZ(1))] \quad (7)$$
$$DTVD = LA \cdot \cos[INC(1)] \quad (8)$$
$$NOR(2) = NOR(1) + DNOR \quad (9)$$
$$EAS(2) = EAS(1) + DEAS \quad (10)$$
$$TVD(2) = TVD(1) + DTVD \quad (11)$$
$$DNOR = NOR(4) - NOR(2) \quad (12)$$
$$DEAS = EAS(4) - EAS(2) \quad (13)$$
$$DTVD = TVD(4) - TVD(2) \quad (14)$$
$$DVS = (DNOR^2 + DEAS^2)^{1/2} \quad (15)$$
$$DMD = (DVS^2 + DTVD^2)^{1/2} \quad (16)$$
$$MDL(4) = MDL(2) + DMD \quad (17)$$
$$INC(3) = \arctan\left(\frac{DVS}{DTVD}\right) \quad (18)$$
$$AZ(3) = \arctan\left(\frac{DEAS}{DNOR}\right) \quad (19)$$
$$DAZ = AZ(3) - AZ(1) \quad (20)$$
$$DOGA = \arccos\{\cos(DAZ) \cdot \sin[INC(1)] \cdot \sin[INC(3)] + \cos[INC(1)] \cdot \cos[INC(3)]\} \quad (21)$$
$$LA = \frac{100 \cdot 180}{BTA \cdot \pi} \cdot \tan\left(\frac{DOGA}{2}\right) \quad (22)$$

Repeat equations 2 through 22 until the value calculated for INC(3) remains constant.

$$MD(3) = MD(1) + \frac{100 \cdot DOGA}{BTA} \quad (23)$$
$$MD(4) = MD(3) + DMD - LA \quad (24)$$
$$DVS = LA \cdot \sin[INC(3)] \quad (25)$$
$$DNOR = DVS \cdot \cos[AZ(3)] \quad (26)$$
$$DEAS = DVS \cdot \sin[AZ(3)] \quad (27)$$

TABLE 1-continued

| Single Curve and Tangent to a Directional Target<br>GIVEN: BTA<br>Starting position: MD(1), TVD(1), EAS(1), NOR(1), INC(1), AZ(1)<br>Target position: TVD(4), EAS(4), NOR(4) | |
|---|---|
| DTVD = LA · cos[INC(3)] | (28) |
| TVD(3) = TVD(2) + DTVD | (29) |
| NOR(3) = NOR(2) + DNOR | (30) |
| EAS(3) = EAS(2) = DEAS | (31) |

Figure 3:
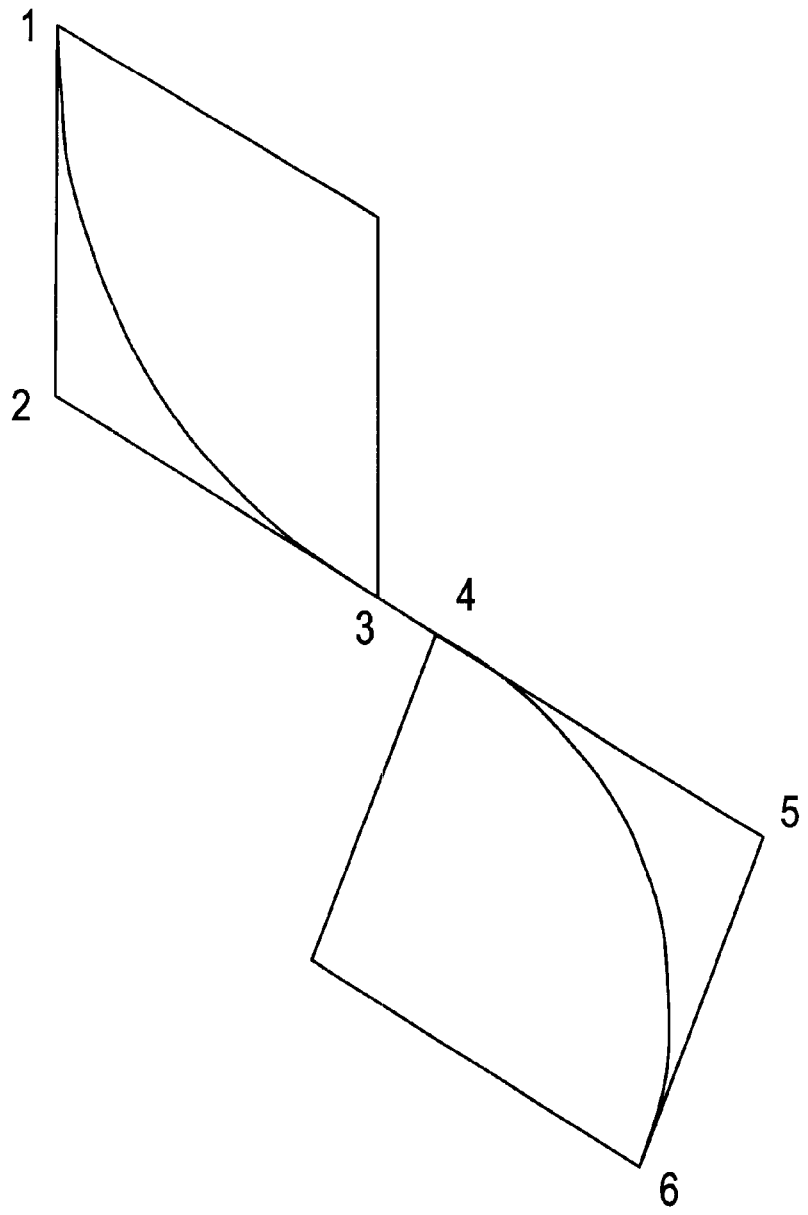
FIG. 3 illustrates a solution for an optimized path including two arcs connected by a tangent line.

FIG. 3 and Table 2 show the procedure for designing the path that requires two circular arcs separated by a straight line segment required to reach a directional target that includes requirements for the entry angle and azimuth.

TABLE 2

| Two Curves with a Tangent to a Directional Target<br>GIVEN: BTA,BTB<br>Starting position: MD(1), TVD(1), EAS(1), NOR(1), INC(1), AZ(1)<br>Target position: TVD(6), EAS(6), NOR(6), INC(6), AZ(6) | |
|---|---|
| Start values: LA = 0 | (1) |
| LB = 0 | (2) |
| MDL(1) = MD(1) | (3) |
| MDL(2) = MDL(1) + LA | (4) |
| MDL(3) = MDL(2) + LA | (5) |
| DVS = LA · sin[INC(1)] | (6) |
| DNOR = DVS · cos[AZ(1)] | (7) |
| DEAS = DVS · sin[AZ(1))] | (8) |
| DTVD = LA · cos[INC(1)] | (9) |
| NOR(2) = NOR(1) + DNOR | (10) |
| EAS(2) = EAS(1) + DEAS | (11) |
| TVD(2) = TVD(1) + DTVD | (12) |
| DVS = LB · sin[INC(6)] | (13) |
| DNOR = DVS · cos[AZ(6)] | (14) |
| DEAS = DVS · sin[AZ(6)] | (15) |
| DTVD = LB · cos[INC(6)] | (16) |
| NOR(5) = NOR(6) − DNOR | (17) |
| EAS(5) = EAS(6) − DEAS | (18) |
| TVD(5) = TVD(6) − DTVD | (19) |
| DNOR = NOR(5) − NOR(2) | (20) |
| DEAS = EAS(5) − EAS(2) | (21) |
| DTVD = TVD(5) − TVD(2) | (22) |
| $DVS = (DNOR^2 + DEAS^2)^{1/2}$ | (23) |
| $DMD = (DVS^2 + DTVD^2)^{1/2}$ | (24) |
| $INC(3) = \arctan\left(\frac{DVS}{DTVD}\right)$ | (25) |
| $AZ(3) = \arctan\left(\frac{DEAS}{DNOR}\right)$ | (26) |
| DAZ = AZ(3) − AZ(1) | (27) |
| DOGA = arc cos{cos(DAZ) · sin[INC(1)]· sin[INC(3)] + cos[INC(1)]· cos[INC(3)]} | (28) |
| $LA = \frac{100 \cdot 180}{BTA \cdot \pi} \cdot \tan\left(\frac{DOGA}{2}\right)$ | (29) |
| DAZ = AZ(6) − AZ(3) | (30) |
| DOGB = arc cos{cos(DAZ) · sin[INC(3)]· sin[INC(6)] + cos[INC(3)]· cos[INC(6)]} | (31) |
| $LB = \frac{100 \cdot 180}{BTB \cdot \pi} \tan\left(\frac{DOGB}{2}\right)$ | (32) |
| Repeat equations 3 through 32 until INC(3) is stable. | |
| DVS = LA · sin[INC(3)] | (33) |
| DNOR = DVS · cos[AZ(3)] | (34) |
| DEAS = DVS · sin[AZ(3))] | (35) |
| DTVD = LA · cos[INC(3)] | (36) |
| NOR(3) = NOR(2) + DNOR | (37) |
| EAS(3) = EAS(2) + DEAS | (38) |
| TVD(3) = TVD(2) + DTVD | (39) |
| INC(4) = INC(3) | (40) |
| AZ(4) = AZ(3) | (41) |

TABLE 2-continued

| Two Curves with a Tangent to a Directional Target<br>GIVEN: BTA,BTB<br>Starting position: MD(1), TVD(1), EAS(1), NOR(1), INC(1), AZ(1)<br>Target position: TVD(6), EAS(6), NOR(6), INC(6), AZ(6) | |
|---|---|
| $DVS = LB \cdot \sin[INC(4)]$ | (42) |
| $DNOR = DVS \cdot \cos[AZ(4)]$ | (43) |
| $DEAS = DVS \cdot \sin[AZ(4))]$ | (44) |
| $DTVD = LB \cdot \cos[INC(4)]$ | (45) |
| $NOR(4) = NOR(5) - DNOR$ | (46) |
| $EAS(4) = EAS(5) - DEAS$ | (47) |
| $TVD(4) = TVD(5) - DTVD$ | (48) |
| $MD(3) = MD(1) + \frac{100 \cdot DOGA}{BTA}$ | (49) |
| $MD(4) = MD(3) + DMD - LA - LB$ | (50) |
| $MD(6) = MD(4) + \frac{100 \cdot DOGB}{BTB}$ | (51) |

Figure 4:
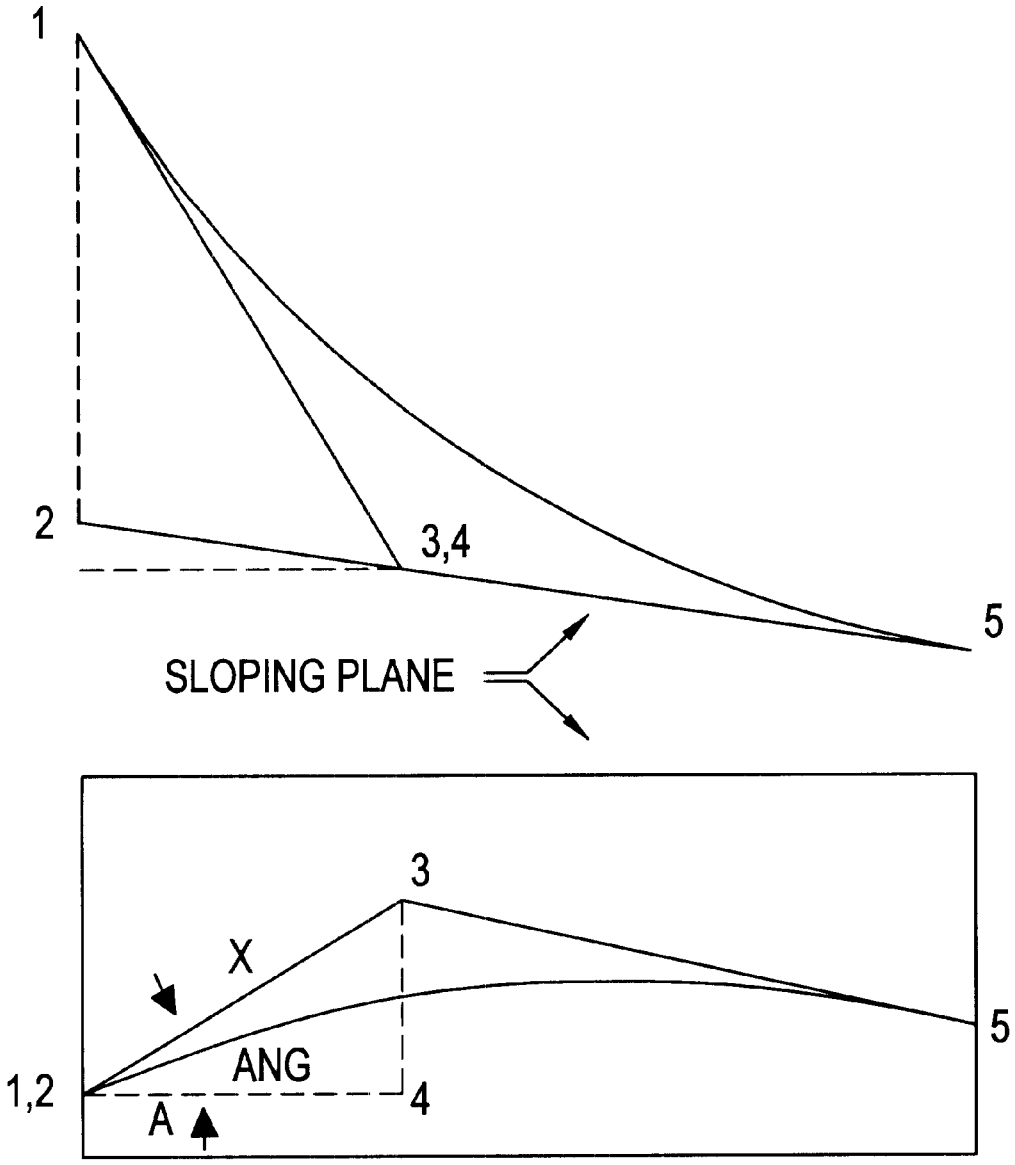
FIG. 4, illustrates a solution for an optimized path including an arc landing on a sloping plane.

FIG. 4 and Table 3 show the calculation procedure for determining the specifications for the circular arc required to drill from a point in space above a horizontal sloping target with a single circular arc. In horizontal drilling operations, the horizontal target is defined by a dipping plane in space and the azimuth of the horizontal well extension. The single circular arc solution for a horizontal target requires that the starting inclination angle be less than the landing angle and that the starting position be located above the sloping target plane.

TABLE 3

| Single Curve Landing on a Sloping Target Plane<br>GIVEN: TARGAZ, BT<br>Starting position: MD(1), TVD(1), NOR(1), EAS(1), INC(1), AZ(1)<br>Sloping target plane: TVDTP, NTP, ETP, DIP, AZDIP | |
|---|---|
| $DNOR = NOR(1) - NTP$ | (1) |
| $DEAS = EAS(1) - ETP$ | (2) |
| $DVS = (DNOR^2 + DEAS^2)^{1/2}$ | (3) |
| $AZD = \arctan\left(\frac{DEAS}{DNOR}\right)$ | (4) |
| $TVD(2) = TVDTP + DVS \cdot \tan \cdot (DIP) \cdot \cos(AZDIP - AZD)$ | (5) |
| $ANGA = AZDIP - AZ(1)$ | (6) |
| $X = \frac{[TVD(2) - TVD(1)] \cdot \tan[INC(1)]}{1 - \cos(ANGA) \cdot \tan(DIP) \cdot \tan[INC(1)]}$ | (7) |
| $TVD(3) = TVD(2) + X \cdot \cos(ANGA) \cdot \tan(DIP)$ | (8) |
| $NOR(3) = NOR(1) + X \cdot COS[AZ(1)]$ | (9) |
| $EAS(3) = EAS(1) + X \cdot \sin[AZ(1)]$ | (10) |
| $LA = \{X^2 + [TVD(3) - TVD(1)]^2\}^{1/2}$ | (11) |
| $AZ(5) = TARGAZ$ | (12) |
| $INC(5) = 90 - \arctan\{\tan(DIP) \cdot \cos[AZDIP - AZ(5)]\}$ | (13) |
| $DOG = \arccos\{\cos[AZ(5) - AZ(1)] \cdot \sin[INC(1)] \cdot \sin[INC(5)] + \cos[INC(1)] \cdot \cos[inc(5)]\}$ | (14) |
| $BT = \frac{100 \cdot 180}{LA \cdot \pi} \tan\left(\frac{DOG}{2}\right)$ | (15) |
| $DVS = LA \cdot \sin[INC(5)]$ | (16) |
| $DNOR = DVS \cdot \cos[AZ(5)]$ | (17) |
| $DEAS = DVS \cdot \sin[AZ(5)]$ | (18) |
| $DTVD = LA \cdot \cos[INC(5)]$ | (19) |
| $NOR(5) = NOR(3) + DNOR$ | (20) |
| $EAS(5) = EAS(3) + DEAS$ | (21) |
| $TVD(5) = TVD(3)\| + DTVD$ | (22) |
| $MD(5) = MD(1) + \frac{100 \cdot DOG}{BT}$ | (23) |

For all other cases the required path can be accomplished with two circular arcs. This general solution in included in FIG. 5 and Table 4.

TABLE 4

Double Turn Landing to a Sloping Target
GIVEN: BT, TARGAZ
Starting position: MD(1), TVD(1), NOR(1), EAS(1), INC(1), AZ(1)
Sloping Target: TVDTP @ NTP & ETP, DIP, AZDIP $$TVDTP0 = TVDTP - NTP \cdot \cos(AZDIP) \cdot \tan(DIP) - ETP \cdot \sin(AZDIP) \cdot \tan(DIP) \quad (1)$$
$$TVDT(1) = TVDTP0 + NOR(1) \cdot \cos(AZDIP) \cdot \tan(DIP) + EAS(1) \cdot \sin(AZDIP) \cdot \tan(DIP) \quad (2)$$
$$INC(5) = 90 - \text{arc}\tan[\tan(DIP) \cdot \cos(AZDIP - TARGAZ)] \quad (3)$$
$$AZ(5) = TARGAZ \quad (4)$$
$$DAZ = AZ(5) - AZ(1) \quad (5)$$
$$DTVD = TVDT(1) - TVD(1) \quad (6)$$

$$DOG2 = \left(\frac{180}{\pi}\right) \cdot \left(\frac{BT \cdot |DTVD| \cdot \pi}{100 \cdot 180}\right)^{1/2} \quad (7)$$

If DTVD > 0 $\quad DOG1 = DOG2 + INC(1) - INC(5)$ (8)
$\quad INC(3) = INC(1) - DOG1$
If DTVD < 0 $\quad DOG1 = DOG2 - INC(1) + INC(5)$ (9)
$\quad INC(3) = INC(1) + DOG1$ $$DAZ1 = \left(\frac{DOG1}{DOG1 + DOG2}\right) \cdot DAZ \quad (10)$$

$$AZ(3) = AZ(1) + DAZ1 \quad (11)$$
$$DAZ2 = DAZ - DAZ1 \quad (12)$$
$$DOGA = \text{arc}\cos\{\cos[DAZ1] \cdot \sin[INC(1)] \cdot \sin[INC(3)] + \cos[INC(1)] \cdot \cos[INC(3)]\} \quad (13)$$
$$DOGB = \text{arc}\cos\{\cos[DAZ2] \cdot \sin[INC(3)] \cdot \sin[INC(5)] + \cos[INC(3)] \cdot \cos[INC(5)]\} \quad (14)$$
$$DMD = LA + LB \quad (15)$$

$$LA = \frac{100 \cdot 180}{\pi \cdot BT} \tan\left(\frac{DOGA}{2}\right) \quad (16)$$

$$LB = \frac{100 \cdot 180}{\pi \cdot BT} \tan\left(\frac{DOGB}{2}\right) \quad (17)$$

$$DVS = LA \cdot \sin[INC(1)] \quad (18)$$
$$DNOR = DVS \cdot \cos[AZ(1)] \quad (19)$$
$$DEAS = DVS \cdot \sin[AZ(1))] \quad (20)$$
$$DTVD = LA \cdot \cos[INC(1)] \quad (21)$$
$$NOR(2) = NOR(1) + DNOR \quad (22)$$
$$EAS(2) = EAS(1) + DEAS \quad (23)$$
$$TVD(2) = TVD(1) + DTVD \quad (24)$$
$$TVDT(2) = TVDTP0 + NOR(2) \cdot \cos(AZDIP) \cdot \tan(DIP) + EAS(2) \cdot \sin(AZDIP) \cdot \tan(DIP) \quad (25)$$
$$HAT(2) = TVDT(2) - TVD(2) \quad (26)$$
$$DVS = LA \cdot \sin[INC(3)] + LB \cdot \sin[INC(3)] \quad (27)$$
$$DNOR = DVS \cdot \cos[AZ(3)] \quad (28)$$
$$DEAS = DVS \cdot \sin[AZ(3)] \quad (29)$$
$$NOR(4) = NOR(2) + DNOR \quad (30)$$
$$EAS(4) = EAS(2) + DEAS \quad (31)$$
$$TVDT(4) = TVDTP0 + NOR(4) \cdot \cos(AZDIP) \cdot \tan(DIP) + EAS(4) \cdot \sin(AZDIP) \cdot \tan(DIP) \quad (32)$$
$$TVD(4) = TVDT(4) \quad (33)$$
$$HAT(4) = TVDT(4) - TVD(4) \quad (34)$$
$$DTVD = TVD(4) - TVD(2) \quad (35)$$
$$\text{IF } DTVD = 0 \quad INC(3) = 90 \quad (36)$$

$$\text{If } DTVD < 0 \quad INC(3) = 180 + \text{arc}\tan\left[\frac{DVS}{DTVD}\right] \quad (37A)$$

$$\text{If } DTVD > 0 \quad INC(3) = \text{arc}\tan\left(\frac{DVS}{DTVD}\right) \quad (37B)$$

$$DOG1 = |INC(3) - INC(1)| \quad (38)$$
$$DOG(2) = |INC(5) - INC(3)| \quad (39)$$

Repeat equations 10 through 39 until DMD = LA + LB $$DVS = LA \cdot \sin[INC(3)] \quad (40)$$
$$DNOR = DVS \cdot \cos[AZ(3)] \quad (41)$$
$$DEAS = DVS \cdot \sin[AZ(3))] \quad (42)$$
$$DTVD = LA \cdot \cos[INC(3)] \quad (43)$$
$$NOR(3) = NOR(2) + DNOR \quad (44)$$
$$EAS(3) = EAS(2) + DEAS \quad (45)$$
$$TVD(3) = TVD(2) + DTVD \quad (46)$$

TABLE 4-continued

| Double Turn Landing to a Sloping Target<br>GIVEN: BT, TARGAZ<br>Starting position: MD(1), TVD(1), NOR(1), EAS(1), INC(1), AZ(1)<br>Sloping Target: TVDTP @ NTP & ETP, DIP, AZDIP | |
|---|---|
| TVDT(3) = TVDTP0 + NOR(3) · cos(AZDIP) · tan(DIP) + EAS(3) · sin(AZDIP) · tan(DIP) | (47) |
| HAT(3) = TVDT(3) − TVD(3) | (48) |
| DVS = LB · sin[INC(3)] | (49) |
| DNOR = DVS · cos[AZ(3)] | (50) |
| DEAS = DVS · sin[AZ(3)] | (51) |
| DTVD = LB · cos[INC(3)] | (52) |
| NOR(4) = NOR(3) + DNOR | (53) |
| EAS(4) = EAS(3) + DEAS | (54) |
| TVD(4) = TVD(3) + DVTD | (55) |
| TVDT(4) = TVDTP0 + NOR(4) · cos(AZDIP) · tan(DIP) + EAS(4) · sin(AZDIP) · tan(DIP) | (56) |
| HAT(4) = TVDT(4) − TVD(4) | (57) |
| DVS = LB · sin[INC(5)] | (58) |
| DNOR = DVS · cos[AZ(5)] | (59) |
| DEAS = DVS · sin[AZ(5)] | (60) |
| DTVD = LB · cos[INC(5)] | (61) |
| NOR(5) = NOR(4) + DNOR | (62) |
| EAS(5) = EAS(4) + DEAS | (63) |
| TVD(5) = TVD(4) + DVTD | (64) |
| TVDT(5) = TVDTP0 + NOR(5) · cos(AZDIP) · tan(DIP) + EAS(5) · sin(AZDIP) · tan(DIP) | (65) |
| HAT(5) = TVDT(5) − TVD(5) | (66) |
| $MD(3) = MD(1) + \frac{100 \cdot DOGA}{BT}$ | (67) |
| $MD(5) = MD(3) + \frac{100 \cdot DOGB}{BT}$ | (68) |

Figure 5:
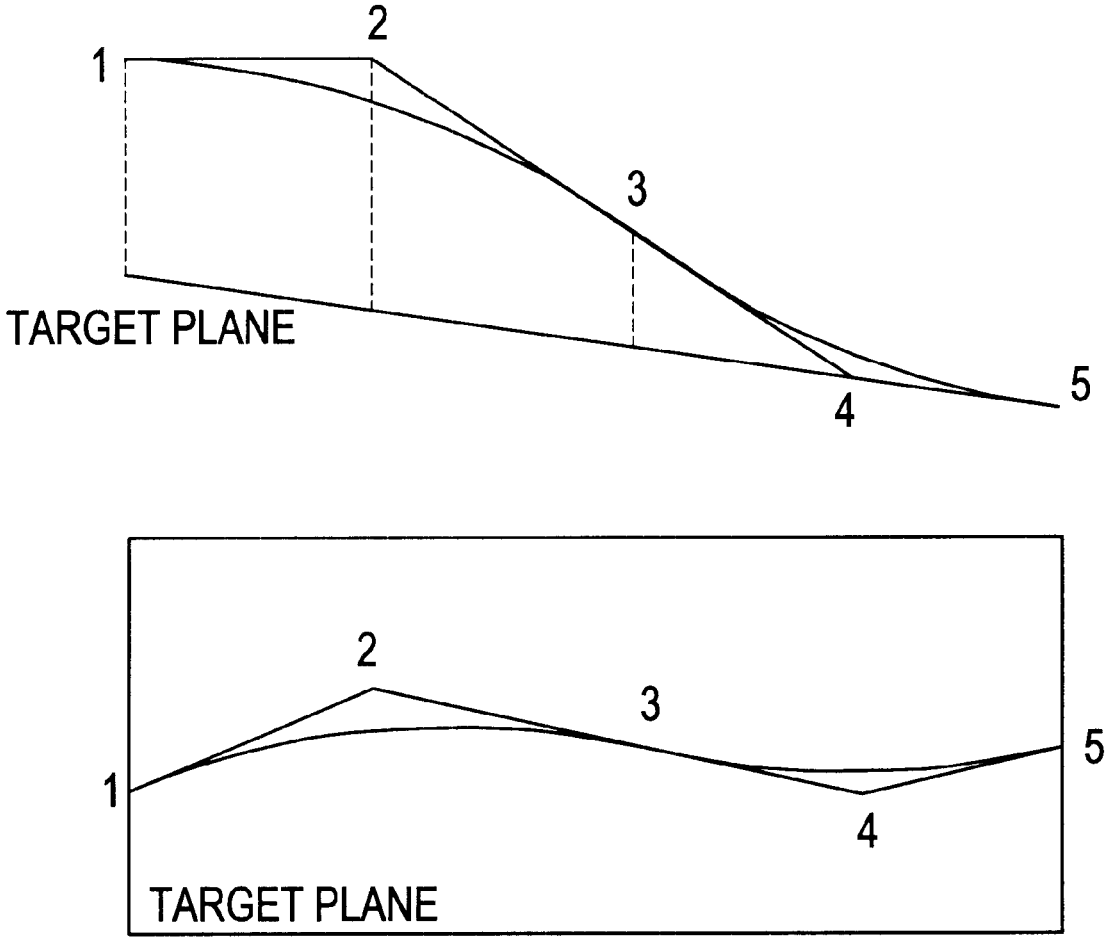
FIG. 5 illustrates a solution for an optimized path including a dual arc path to a sloping plane.

In summary, if the directional target specification also includes a required entry angle and azimuth, the path from any point above the target requires two circular arc segments separated by a straight line section. See FIG. 3. When drilling to horizontal well targets, the goal is to place the wellbore on the plane of the formation, at an angle that parallels the surface of the plane and extends in the pre-planned direction. From a point above the target plane where the inclination angle is less than the required final angle, the optimum path is a single circular arc segment as shown in FIG. 4. For all other borehole orientations, the landing trajectory requires two circular arcs as is shown in FIG. 5. The mathematical calculations that are needed to obtain the optimum path from the above Tables 1–4 are well within the programming abilities of one skilled in the art. The program can be stored to any computer readable medium either downhole or at the surface. Particular examples of these path determinations are provided below.

Directional Example

Figure 7:
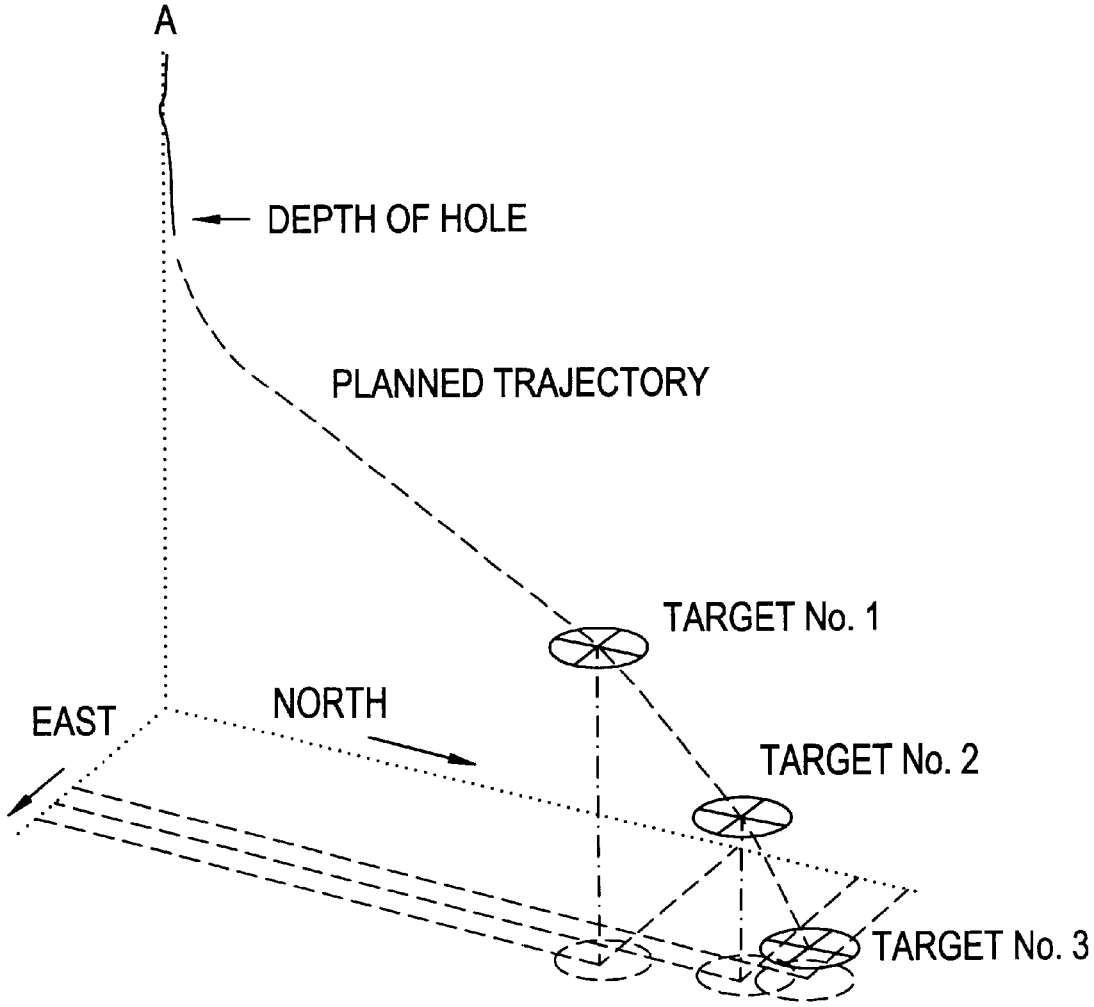
FIG. 7 illustrates a first example of determining optimum paths according to a preferred embodiment of the invention.

FIG. 7 shows the planned trajectory for a three-target directional well. The specifications for these three targets are as follows.

| | Vertical Depth Ft. | North Coordinate Ft. | East Coordinate Ft. |
|---|---|---|---|
| Target No. 1 | 6700 | 4000 | 1200 |
| Target No. 2 | 7500 | 4900 | 1050 |
| Target No. 3 | 7900 | 5250 | 900 |

The position of the bottom of the hole is defined as follows.

| | |
|---|---|
| Measured depth | 2301 ft. |
| Inclination angle | 1.5 degrees from vertical |
| Azimuth angle | 120 degrees from North |
| Vertical depth | 2300 ft. |

-continued

| | |
|---|---|
| North coordinate | 20 ft. |
| East Coordinate | 6 ft. |

Design Curvature Rates.

| Vertical Depth | Curvature Rate |
|---|---|
| 2300 to 2900 ft | 2.5 deg/100 ft |
| 2900 to 4900 ft | 3.0 deg/100 ft |
| 4900 to 6900 ft | 3.5 deg/100 ft |
| 6900 to 7900 ft | 4.0 deg/100 ft |

The required trajectory is calculated as follows.

For the first target we use the FIG. 2 and Table 1 solution.

Figure 8:
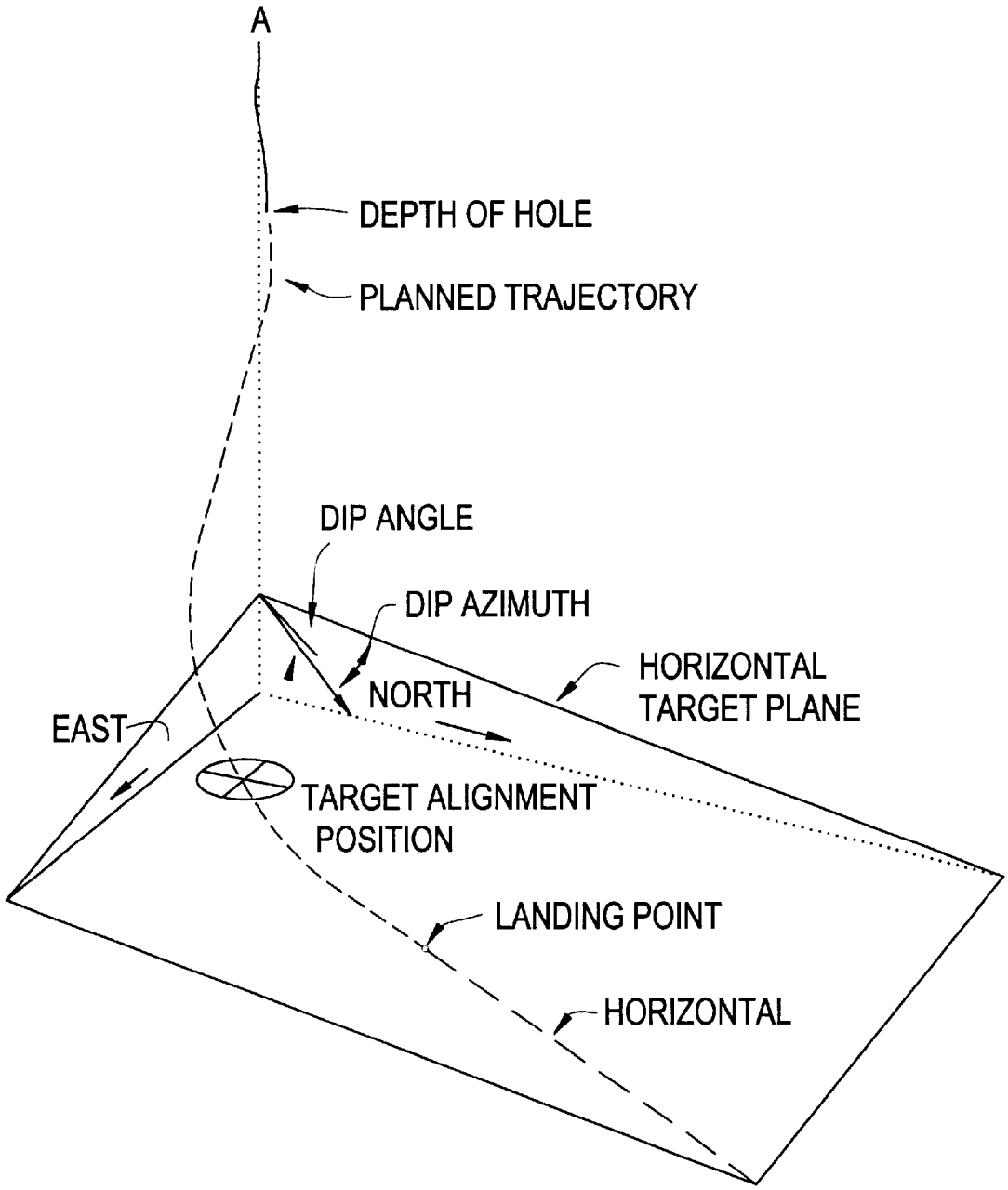
FIG. 8 illustrates a second example of determining optimum paths according to a preferred embodiment of the invention.

BTA = 2.5 deg/100 ft
MDL(1) = 2301 ft
INC(1) = 1.5 deg
AZ(1) = 120 deg North
TVD(1) = 2300 ft
NOR(1) = 20 ft
EAS(1) = 6 ft
LA = 1121.7 ft
DOGA = 52.2 deg
MDL(2) = 3422.7 ft
TVD(2) = 3420.3 ft
NOR(2) = 5.3 ft
EAS(2) = 31.4 ft
INC(3) = 51.8 deg
AZ(3) = 16.3 deg North azimuth
MDL(3) = 4542.4 ft
MD(3) = 4385.7 ft
TVD(3) = 4113.9 ft
NOR(3) = 850.2 ft
EAS(3) = 278.6 ft
MD(4) = 8564.0 ft
MDL(4) = 8720.7 ft
INC(4) = 51.8 deg
AZ(4) = 16.3 deg North -continued TVD(4) = 6700 ft
NOR(4) = 4000 ft
EAS(4) = 1200 ft For second target we use the FIG. 2 and Table 1 solution BTA = 3.5 deg/100 ft
MD(1) = 8564.0 ft
MDL(1) = 8720.9 ft
INC(1) = 51.8 deg
AZ(1) = 16.3 deg North
TVD(1) = 6700 ft
NOR(1) = 4000 ft
EAS(1) = 1200 ft
LA = 458.4 ft
DOGA = 31.3 deg
MDL(2) = 9179.3 ft
TVD(2) = 6983.5 ft
NOR(2) = 4345.7 ft
EAS(2) = 1301.1 ft
INC(3) = 49.7 deg
AZ(3) = 335.6 deg North
MDL(3) = 9636.7 ft
MD(3) = 9457.8 ft
TVD(3) = 7280.1 ft
NOR(3) = 4663.4 ft
EAS(3) = 1156.9 ft
MD(4) = 9797.7 ft
MDL(4) = 9977.4 ft
INC(4) = 49.7 deg
AZ(4) = 335.6 deg North
TVD(4) = 7500 ft
NOR(4) = 4900 ft
EAS(4) = 1050 ft For the third target we also use the FIG. 2 and Table 1 solution BTA = 4.0 deg/100 ft
MD(1) = 9797.7 ft
MDL(1) = 9977.4 ft
INC(1) = 49.7 deg
AZ(1) = 335.6 deg North
TVD(1) = 7500 ft
NOR(1) = 4900 ft
EAS(1) = 1050 ft
LA = 92.8 ft
DOGA = 7.4 deg
MDL(2) = 10070.2 ft
TVD(2) = 7560.0 ft
NOR(2) = 4964.5 ft
EAS(2) = 1020.8 ft
INC(3) = 42.4 deg
AZ(3) = 337.1 deg North
MDL(3) = 10163.0 ft
MD(3) = 9983.1 ft
TVD(3) = 7628.6 ft
NOR(3) = 50221 ft
EAS(3) = 996.4 ft
MD(4) = 10350.4 ft
MDL(4) = 10530.2 ft
INC(4) = 42.4 deg
AZ(4) = 337.1 deg North
TVD(4) = 7900 ft
NOR(4) = 5250 ft
EAS(4) = 900 ft Horizontal Example FIG. 8 shows the planned trajectory for drilling to a horizontal target. In this example a directional target is used to align the borehole with the desired horizontal path. The directional target is defined as follows.

6700 ft Vertical depth
400 ft North coordinate
1600 ft East coordinate
45 deg inclination angle
15 deg North azimuth The horizontal target plan has the following specs:

6800 ft vertical depth at 0 ft North and 0 ft East coordinate
30 degrees North dip azimuth
15 degree North horizontal wellbore target direction
3000 ft horizontal displacement The position of the bottom of the hole is as follows:

| | |
|---|---|
| Measured depth | 3502 ft |
| Inclination angle | 1.6 degrees |
| Azimuth angle | 280 degrees North |
| Vertical depth | 3500 ft |
| North coordinate | 10 ft |
| East coordinate | −20 ft |

The design curvature rates for the directional hole are:

| Vertical Depth | Curvature Rate |
|---|---|
| 3500–4000 | 3 deg/100 ft |
| 4000–6000 | 3.5 deg/100 ft |
| 6000–7000 | 4 deg/100 ft |

The maximum design curvature rates for the horizontal well are:

13 deg/100 ft

The trajectory to reach the directional target is calculated using the Solution shown on FIG. 3.

BTA = 3.0 deg/100 ft
BTB = 3.5 deg/100 ft
MDL(1) = 3502 ft
MD(1) = 3502 ft
INC(1) = 1.6 deg
AZ(1) = 280 degrees North
TVD(1) = 3500 ft
NOR(1) = 10 ft
EAS(1) = −20 ft
LA = 672.8 ft
LB = 774.5 ft
DOGA = 38.8 deg
DOGB = 50.6 deg
MDL(2) = 4174.8 ft
TVD(2) = 4172.5 ft
NOR(2) = 13.3 ft
EAS(2) = −38.5 ft
INC(3) = 37.2 deg
AZ(3) = 95.4 deg North
MDL(3) = 4847.5 ft
MD(3) = 4795.6 ft
TVD(3) = 4708.2 ft
NOR(3) = −25.2 ft
EAS(3) = 366.5 ft
INC(4) = 37.2 deg
AZ(4) = 95.4 deg North
MDL(4) = 5886.4 ft
MD(4) = 5834.5 ft
TVD(4) = 5535.6 ft
NOR(4) = −84.7 ft
EAS(4) = 992.0 ft
MDL(5) = 6660.8 ft
TVD(5) = 6152.4 ft
NOR(5) = −129.0 ft
EAS(5) = 1458.3 ft
MD(6) = 7281.2 ft
MDL(6) = 7435.2 ft
INC(6) = 45 deg
AZ(6) = 15 deg North
TVD(6) = 6700 ft
NOR(6) = 400 ft
EAS(6) = 1600 ft The horizontal landing trajectory uses the solution shown on FIG. 4 and Table 3. The results are as follows.

The starting position is:

MD(1) = 7281.3 ft
INC(1) = 45 deg
AZ(1) = 15 deg North
TVD(1) = 6700 ft
NOR(1) = 400 ft -continued EAS(1) = 1600 ft
The sloping target specification is:

TVDTP = 6800 ft
NTP = 0 ft
ETP = 0 ft
DIP = 4 deg
AZDIP = 30 deg North
The horizontal target azimuth is:

TARGAZ = 15 deg North
The Table 3 solution is as follows:

DNOR = 400 ft
DEAS = 1600 ft
DVS = 1649.2 ft
AZD = 76.0 deg North
TVD(2) = 6880.2 ft
ANGA = 15 deg
X = 193.2 ft
TVD(3) = 6893.2 ft
NOR(3) = 586.6 ft
EAS(3) = 1650.0 ft
LA = 273.3 ft
AZ(5) = 15 deg North
INC(5) = 86.1 deg
DOG = 41.1 deg
BT = 7.9 deg/100 ft
DVS = 272.6 ft
DNOR = 263.3 ft
DEAS = 70.6 ft
DTVD = 18.4 ft
NOR(5) = 850.0 ft
EAS(5) = 1720.6 ft
TVD(5) = 6911.6 ft
MD(5) = 7804.1 ft
The end of the 3000 ft horizontal is determined as follows:

DVS = 2993.2 ft
DNOR = 2891.2 ft
DEAS = 774.7 ft
DTVD = 202.2 ft
NOR = 3477.8 ft
EAS = 2495.3 ft
TVD = 7113.8 ft
MD = 10804.1 ft

It is well known that the optimum curvature rate for directional and horizontal wells is a function of the vertical depth of the section. Planned or desired curvature rates can be loaded in the downhole computer in the form of a table of curvature rate versus depth. The downhole designs will utilize the planned curvature rate as defined by the table. The quality of the design can be further optimized by utilizing lower curvature rates than the planned values whenever practical. As a feature of the preferred embodiments, the total dogleg curvature of the uppermost circular arc segment is compared to the planned or desired curvature rate. Whenever the total dogleg angle is found to be less than the designer's planned curvature rate, the curvature rate is reduced to a value numerically equal to the total dogleg. For example, if the planned curvature rate was 3.5°/100 ft and the required dogleg was 0.5°, a curvature rate of 0.5°/100 ft should be used for the initial circular arc section. This procedure will produce smoother less tortuous boreholes than would be produced by utilizing the planned value.

The actual curvature rate performance of directional drilling equipment including rotary steerable systems is affected by the manufacturing tolerances, the mechanical wear of the rotary steerable equipment, the wear of the bit, and the characteristics of the formation. Fortunately, these factors tend to change slowly and generally produce actual curvature rates that stay fairly constant with drill depth but differ somewhat from the theoretical trajectory. The down hole computing system can further optimize the trajectory control by computing and utilizing a correction factor in controlling the rotary steerable system. The magnitude of the errors can be computed by comparing the planned trajectory between survey positions with the actual trajectory computed from the surveys. The difference between these two values represents a combination of the deviation in performance of the rotary steerable system and the randomly induced errors in the survey measurement process. An effective error correction process should minimize the influence of the random survey errors while responding quickly to changes in the performance of the rotary steerable system. A preferred method is to utilize a weighted running average difference for the correction coefficients. A preferred technique is to utilize the last five surveys errors and average them by weighting the latest survey five-fold, the second latest survey four-fold, the third latest survey three-fold, the fourth latest survey two-fold, and the fifth survey one time. Altering the number of surveys or adjusting the weighting factors can be used to further increase or reduce the influence of the random survey errors and increase or decrease the responsiveness to a change in true performance. For example, rather than the five most recent surveys, the data from ten most recent surveys may be used during the error correction. The weighting variables for each survey can also be whole or fractional numbers. The above error determinations may be included in a computer program, the details of which are well within the abilities of one skilled in the art.

Figure 9:
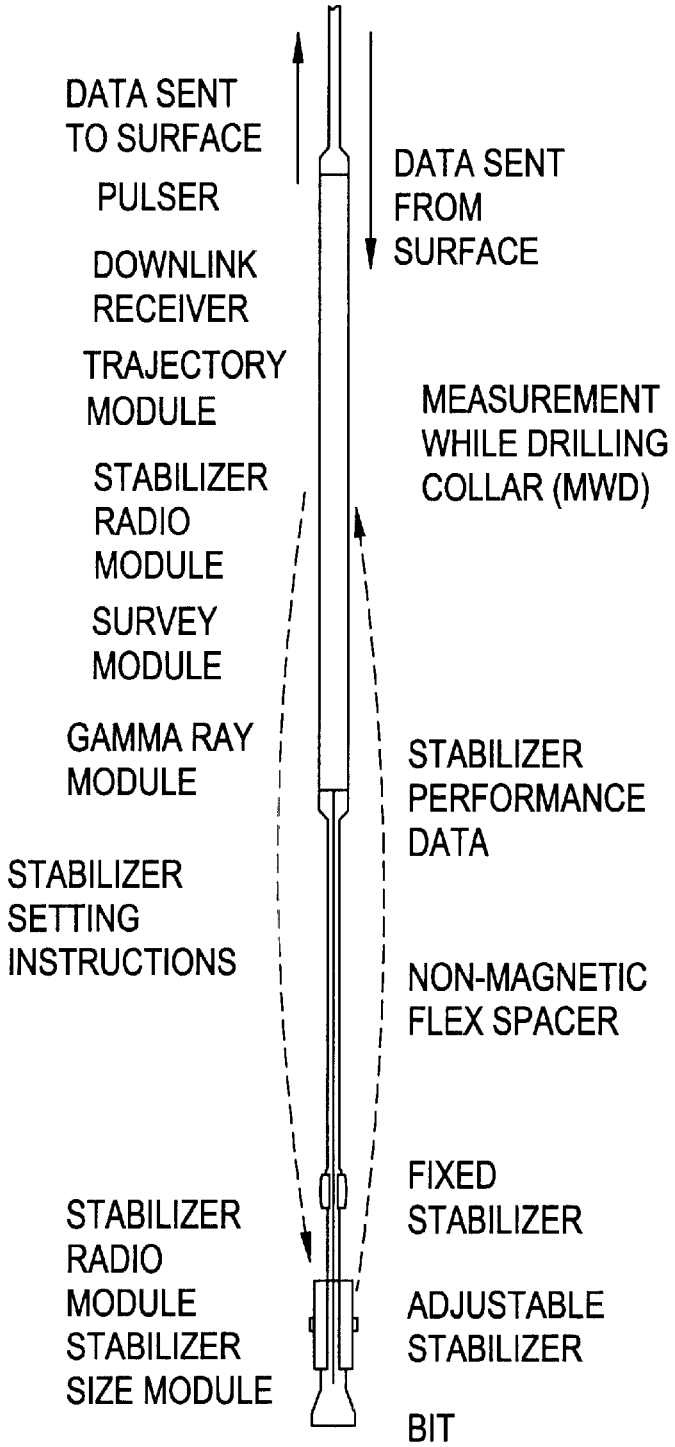
FIG. 9 illustrates a bottom hole assembly of an apparatus according to a preferred embodiment of the invention.

The above embodiments for directional and horizontal drilling operations can be applied with known rotary-steerable directional tools that effectively control curvature rates. One such tool is described by the present inventor in U.S. Pat. No. 5,931,239 patent. The invention is not limited by the type of steerable system. FIG. 9 illustrates the downhole assembly which is operable with the preferred embodiments. The rotary-steerable directional tool 1 will be run with an MWD tool 2. A basic MWD tool, which measures coordinates such as depth, azimuth and inclination, is well known in the art. In order to provide the improvements of the present invention, the MWD tool of the inventive apparatus includes modules that perform the following functions.

1. Receives data and instructions from the surface.
2. Includes a surveying module that measures the inclination angle and azimuth of the tool
3. Sends data from the MWD tool to a receiver at the surface
4. A two-way radio link that sends instructions to the adjustable stabilizer and receives performance data back from the stabilizer unit
5. A computer module for recalculating an optimum path based on coordinates of the drilling assembly.

There are three additional methods that can be used to make the depths of each survey available to the downhole computer. The simplest of these is to simply download the survey depth prior to or following the surveying operations. The most efficient way of handling the survey depth information is to calculate the future survey depths and load these values into the downhole computer before the tool is lowered into the hole. The least intrusive way of predicting survey depths is to use an average length of the drill pipe joints rather than measuring the length of each pipe to be added, and determining the survey depth based on the number of pipe joints and the average length.

It is envisioned that the MWD tool could also include modules for taking Gamma-Ray measurements, resistivity and other formation evaluation measurements. It is anticipated that these additional measurements could either be recorded for future review or sent in real-time to the surface.

The downhole computer module will utilize; surface loaded data, minimal instructions downloaded from the surface, and downhole measurements, to compute the position of the bore hole after each survey and to determine the optimum trajectory required to drill from the current position of the borehole to the directional and horizontal targets. A duplicate of this computing capability can optionally be installed at the surface in order to minimize the volume of data that must be sent from the MWD tool to the surface. The downhole computer will also include an error correction module that will compare the trajectory determined from the surveys to the planned trajectory and utilize those differences to compute the error correction term. The error correction will provide a closed loop process that will correct for manufacturing tolerances, tool wear, bit wear, and formation effects.

The process will significantly improve directional. and horizontal drilling operations through the following:

1. Only a single bottom hole assembly design will be required to drill the entire directional well. This eliminates all of the trips commonly used in order to change the characteristics of the bottom hole assembly to better meet the designed trajectory requirements.
2. The process will drill a smooth borehole with minimal tortuosity. The process of redesigning the optimum trajectory after each survey will select the minimum curvature hole path required to reach the targets. This will eliminate the tortuous adjustments typically used by directional drillers to adjust the path back to the original planned trajectory.
3. The closed loop error correction routine will minimize the differences between the intended trajectory and the actual trajectories achieved. This will also lead to reduced tortusity.
4. Through the combination of providing a precise control of curvature rate and the ability to redetermine the optimum path, the invention provides a trajectory that utilizes the minimum practical curvature rates. This will further expand the goal of minimizing the tortuosity of the hole.

While preferred embodiments of the invention have been described above, one skilled in the art would recognize that various modifications can be made thereto without departing from the spirit of the invention.

What is claimed:

1. A method of drilling a borehole form an above ground surface to one or more sub-surface targets according to a reference trajectory plan, said method comprising:

determining at predetermined depths below the ground surface, a present location of a drill bit for drilling said borehole; and calculating a new trajectory plan in three-dimensional space to said one or more sub-surface targets based on coordinates of said present location of the drill bit, said new trajectory plan being determined independently of the reference trajectory plan.

2. The method of claim 1, wherein said new trajectory plan includes a single curvature between said present location of the drill bit and a first sub-surface target of said one or more sub-surface targets.

3. The method of claim 2, wherein said single curvature is determined based on a present location of the drill bit and a position of said first sub-surface target.

4. The method of claim 3, wherein said single curvature is estimated by a first tangent line segment and a second tangent line segment, each of the first and second tangent line segments having a length LA and meeting at an intersecting point, where LA=R tan (DOG/2), wherein R=a radius of a circle defining said single curvature, and DOG=an angle defined by a first and second radial line of the circle defining said single curvature to respective non-intersecting endpoints of the first and second tangent line segments.

5. The method of claim 3, wherein said new trajectory plan includes said single curvature and a tangent line from an end of the said single curvature which is closest to said first sub-surface target.

6. The method of claim 4, wherein said first sub-surface target comprises a horizontal well with a required angle of entry and azimuth said present location of said drill bet is at a depth which is more shallow than said first sub-surface target.

7. The method of claim 1, wherein a first of said sub-surface targets includes a target, having requirements for at least one of entry angle and azimuth, and said new trajectory plan includes a first curvature and a second curvature.

8. The method of claim 7, wherein at least one of said first and second curvature is estimated by a first tangent line segment A and a second tangent line segment B, each of the first and second tangent line segments having a length LA and said tangent line segments meeting at an intersecting point C, where LA=R tan (DOG/2), wherein R=a radius of a circle defining at least one of said first and second curvature, and DOG=an angle defined by a first and second radial line of the circle defining said at least one of said first and second curvature to respective non-intersecting endpoints of the first and second tangent line segments.

9. The method of claim 8, wherein said first and second curvature are interconnected by a straight line joining a non-intersecting endpoint of the first and second tangent line segments corresponding to said first curvature with a non-intersecting endpoint of the first and second tangent line segments corresponding to said second curvature.

10. The method of claim 1, wherein determining said present location of the drill bit comprises ascertaining coordinates for a borehole depth and measuring an inclination and an azimuth, wherein the borehole depth is predetermined based on a number of drill segments added together to drill said borehole to said present location.

11. The method of claim 1, wherein determining said present location of the drill bit comprises ascertaining coordinates for a borehole depth and measuring an inclination and an azimuth, wherein the borehole depth is determined based on a communication of a depth measurement provided from a drilling station located above ground.

12. The method of claim 1, further comprising measuring inclination and azimuth angles of a new borehole drilled according to the new trajectory plan at at least a first location, a second location and a third location in said new borehole, calculating actual trajectories of the new borehole between the first location and the second location, and between the second location and the third location, comparing the actual trajectories with the new trajectory plan used to drill the new borehole between said first, second and third locations, and determining an error between the actual trajectories and the new trajectory plan to determine an error correction term, wherein said error correction term is calculated as a weighted average, which weights more recent error calculations more heavily than less recent error calculations.

13. The method of claim 1, wherein the predetermined depths are anticipated depths, said method further comprising loading the anticipated depths into a processor that is lowered into the borehole, said loading occurring while the processor is at the above ground surface prior to being lowered into the borehole.

14. The method of claim 13, wherein the anticipated depths are determined based on an average length of drill pipe segments.

15. A computer readable medium operable with an apparatus for drilling a borehole from an above ground surface to one or more sub-surface targets according to a reference trajectory plan, said computer readable medium comprising:

computer readable program means for determining at predetermined depths below the ground surface, a present location of a drill bit for drilling said borehole;

computer readable program means for calculating a new trajectory plan in three-dimensional space to said one or more sub-surface targets based on coordinates of said present location of the drill bit, said new trajectory plan being determined independently of the reference trajectory plan.

16. The computer readable medium of claim 15, wherein said computer readable program means for calculating said new trajectory plan calculates a single curvature between said present location of the drill bit and a first sub-surface target of said one or more sub-surface targets.

17. The computer readable medium of claim 16, wherein said single curvature is estimated by a first tangent line segment and a second tangent line segment, each of the first and second tangent line segments having a length LA and meeting at an intersecting point, where LA=R tan (DOG/2), wherein R=a radius of a circle defining said single curvature, and DOG=an angle defined by a first and second radial line of the circle defining said single curvature to respective non-intersecting endpoints of the first and second tangent line segments.

18. The computer readable medium of claim 17, wherein said new trajectory plan includes said single curvature and a tangent line from an end of the said single curvature which is closest to said first sub-surface target.

19. The computer readable medium of claim 16, wherein said first sub-surface target comprises a horizontal well with a required angle of entry and azimuth and said present location of said drill bit is at a depth which is more shallow than said first sub-surface target.

20. The computer readable medium of claim 15, wherein a first of said sub-surface targets includes a target, having requirements for at least one of entry angle and azimuth, and said new trajectory includes a first curvature and a second curvature.

21. The computer readable medium of claim 20, wherein at least one of said first and second curvature is estimated by a first tangent line segment A and a second tangent line segment B, each of said first and second tangent line segments having a length LA, said tangent line segments meeting at an intersecting point C, where LA=R tan (DOG/2), wherein R=a radius of a circle defining at least one of said first and second curvature, and DOG=an angle defined by a first and second radial line of the circle defining said at least one of said first and second curvature to respective non-intersecting endpoints of the first and second tangent line segments.

22. The computer readable medium of claim 21, wherein said first and second curvature are interconnected by a straight line joining a non-intersecting endpoint of the first and second tangent line segments corresponding to said first curvature with a non-intersecting endpoint of the first and second tangent line segments corresponding to said second curvature.

23. The computer readable medium of claim 15, wherein said computer readable program means for determining said present location of the drill bit comprises ascertaining coordinates for a borehole depth, wherein the borehole depth is predetermined based on a number of drill segments added together to drill said borehole to said present location.

24. The computer readable medium method of claim 15, wherein computer readable program means for determining said present location of the drill bit comprises ascertaining coordinates for a borehole depth, wherein the borehole depth is determined based on a communication of a depth measurement provided from a drilling station located above ground.

25. The computer readable medium of claim 15, further comprises a computer readable program means for receiving measurements for inclination and azimuth angles at at least a first location, a second location, and a third location in a new borehole drilled according to the new trajectory plan, and for calculating actual trajectories of the new borehole between the first location and the second location, and between the second location and the third location, comparing the actual trajectories with the new trajectory plan used to drill the new borehole between said first, second and third locations, and determining an error between the actual trajectories and the new trajectory plan to determine an error correction term, wherein said error correction term is calculated as a weighted average, which weights more recent error calculations more heavily than less recent error calculations.

26. An apparatus for drilling a borehole from an above ground surface to one or more sub-surface targets according to a reference trajectory plan, comprising:

a device for determining at predetermined depths below the ground surface, a present location of a drill bit for drilling said borehole; and a device for calculating a new trajectory plan in three-dimensional space to said one or more sub-surface targets based on coordinates for said present location of the drill bit, said new trajectory plan being independent of the reference trajectory plan.

27. The apparatus of claim 26, wherein said device for calculating a new trajectory plan calculates a single curvature between said present location of the drill bit and a first sub-surface target of said one or more sub-surface targets.

28. The apparatus of 27, wherein said device for calculating said new trajectory plan approximates said single curvature by a first tangent line segment and a second tangent line segment, each of the first and second tangent line segments having a length LA and meeting at an intersecting point, where LA=R tan (DOG/2), wherein R=a radius of a circle defining said single curvature, and DOG=an angle defined by a first and second radial line of the circle defining said single curvature to respective non-intersecting endpoints of the first and second tangent line segments.

29. The apparatus of claim 28, wherein said device for calculating said new trajectory plan calculates said single curvature and a tangent line from an end of the said single curvature which is closest to said first sub-surface target.

30. The apparatus of claim 26, wherein a first of said sub-surface targets includes a target, having requirements for at least one of entry angle and azimuth, and said device for calculating said new trajectory plan calculates a first curvature and a second curvature.

31. The apparatus of claim 30, wherein said device for calculating said new trajectory plan estimates at least one of said first and second curvature by a first tangent line segment A and a second tangent line segment B, each of the first and second tangent line segments having a length LA and said tangent line segments meeting at an intersecting point C, where LA=R tan (DOG/2), wherein R=a radius of a circle defining said single curvature, and DOG=an angle defined by a first and second radial line of the circle defining said single curvature to respective non-intersecting endpoints of the first and second tangent line segments.

32. The apparatus of claim 31, wherein said device for calculating said new trajectory plan determines a straight line segment joining first and second curvatures, said straight line joining a non-intersecting endpoint of the first and second tangent line segments corresponding to said first curvature with a non-intersecting endpoint of the first and second tangent line segments corresponding to said second curvature.

33. The apparatus of claim 27, wherein said first sub-surface target comprises a horizontal well with a required angle of entry and azimuth and said present location of said drill bit is at a depth which is more shallow than said first sub-surface target.

34. The apparatus of claim 26, wherein said device for determining said present location of the drill bit comprises means for ascertaining coordinates for a borehole depth, wherein the borehole depth is predetermined based on a number of drill segments added together to drill said borehole to said present location.

35. The apparatus of claim 26, wherein said device for determining said present location of the drill bit comprises means for ascertaining coordinates for a borehole depth, wherein the borehole depth is determined based on a communication of a depth measurement provided from a drilling station located above ground.

36. The apparatus of claim 26, further comprising means for measuring at least one of an azimuth and inclination angle of a new borehole drilled according to the new trajectory plan at least a first location, a second location, and a third location in said new borehole;

means for calculating actual trajectories of the new borehole between the first location and the second location, and between the second location and the third location; and means for determining an error between the actual trajectories and the new trajectory plan used to drill said new borehole between said first, second and third locations to determine an error correction term, wherein said error correction term is calculated as a weighted average, which weights more recent error calculations more heavily than less recent error calculations.

* * * * *